US005707904A

United States Patent [19]

Gray et al.

[11] Patent Number: 5,707,904

[45] Date of Patent: Jan. 13, 1998

[54] FABRIC FOR BACKLIT SIGNS AND AWNINGS

[75] Inventors: Keith N. Gray, Greensboro; Earl T. Crouch, High Point, both of N.C.; Cheryl D. Malloy, Chesterfield, S.C.

[73] Assignee: Highland Industries, Inc., Greensboro, N.C.

[21] Appl. No.: 594,984

[22] Filed: Jan. 31, 1996

[51] Int. Cl.[6] ..... B32B 7/00

[52] U.S. Cl. ..... 442/46; 442/43; 427/264; 427/273; 427/412

[58] Field of Search ..... 428/246, 247, 428/252, 255; 442/43, 46; 427/264, 273, 412

[56] References Cited

U.S. PATENT DOCUMENTS

| | | | |
|---|---|---|---|
| 3,790,431 | 2/1974 | Tung | 161/3.5 |
| 3,941,778 | 3/1976 | Mueller et al. | 260/240 B |
| 4,005,558 | 2/1977 | Tung | 40/132 R |
| 4,104,468 | 8/1978 | Valenti | 542/447 |
| 4,245,282 | 1/1981 | Sokol | 362/84 |
| 4,513,107 | 4/1985 | Fabbrini | 524/56 |
| 4,542,078 | 9/1985 | Fitzer et al. | 428/914 |
| 4,565,842 | 1/1986 | Fitzer et al. | 524/57 |
| 4,692,847 | 9/1987 | Gandy | 362/152 |
| 4,737,224 | 4/1988 | Fitzer et al. | 156/240 |
| 4,900,614 | 2/1990 | Miyazato et al. | 428/251 |
| 5,021,931 | 6/1991 | Matsui et al. | 362/84 |
| 5,282,117 | 1/1994 | Fritts | 362/223 |

*Primary Examiner*—Christopher Raimund
*Attorney, Agent, or Firm*—Rhodes Coats & Bennett, L.L.P.

[57] ABSTRACT

An awning fabric for use with a backlit sign of the type having a light source disposed on one side of the awning fabric. The awning fabric includes a scrim and a translucent coating on at least one side of the scrim. The scrim is treated with an optical brightener. When the awning fabric is viewed by an observer from the side opposite the light source, the visibility of the scrim to the observer is minimized. The translucent coating may be plastisol. The optical brightener is preferably a fluorescent whitening agent comprising a stilbene derivative. Also disclosed is a method for producing an awning fabric. The method includes applying an optical brightener to a scrim and applying a translucent coating onto at least one side of the scrim. The method may further include applying an opaque coating onto the translucent coating. Thereafter, a solvent is selectively applied to the opaque coating thereby forming a selected pattern on the awning fabric.

29 Claims, 4 Drawing Sheets

282
283
284
280
260
20
200
258
256
250
34
252
254
16
212
210
211
16A
206
204
202
12
14

FABRIC FOR BACKLIT SIGNS AND AWNINGS

FIELD OF THE INVENTION

The present invention is related to illuminated signs and awnings, and, more particularly, is directed to a fabric for backlit signs and awnings.

BACKGROUND OF THE INVENTION

Backlit signs and awnings are widely used, particularly for outdoor environments. Typically, backlit signs and awnings comprise a translucent sheet or panel having a light source placed on a side opposite the side from which the sign or awning is to be viewed. The sheet or panel is stretched about an aluminum framework. By selectively printing opaque regions on the fabric panel, words or graphics may be formed by the translucent portions of the fabric panel. The overall effect is a lighted sign which may be viewed during the day and at night. Such signs are relatively durable and cost effective.

The material used to form the awning is typically PVC plastisol or a related PVC-based material. The plastisol has limited durability, tear resistance, and integrity, particularly after prolonged exposure to the elements and UV radiation. Therefore, it is necessary to provide a substrate or scrim on which the plastisol is applied to give the awning fabric the desired strength, durability, and integrity. Moreover, the translucent material tends to change color, usually yellowing, due to the exposure to UV radiation and heat.

There have been some attempts to utilize a scrim or woven mesh panel for backlit awnings. However, the provision of a scrim significantly compromises the aesthetic appeal of the ultimate backlit awning sign. The scrim of conventional awning fabrics tends to absorb substantially all of the incident light, making the outline of the scrim pattern highly visible to the observer on the side of the fabric opposite the light source. In an attempt to mask the mesh outline, manufacturers have attempted to reduce the overall area of the awning fabric covered by the scrim to obtain more uniform transmission of the light through the fabric. This is accomplished by using low denier yarns to form the scrim and/or enlarging the interstices defined within the scrim. The result of these attempts to improve the aesthetic functionality of the awning fabric is a proportionate reduction in the durability and strength of the fabric. Thus, there is a need for an awning fabric having both low visibility fabric scrim, high strength and durability. There is a need for a method for forming such an awning fabric.

SUMMARY OF THE INVENTION

The present invention is directed to an awning fabric for use with a backlit sign or awning of the type having a light source disposed on one side of the awning fabric. The awning fabric includes a woven scrim and a translucent coating on at least one side of the scrim. The scrim is treated with an optical brightener. When the awning fabric is viewed by an observer from the side opposite the light source, uniformity of light transmission through the fabric is optimized and the visibility of the scrim to the observer is minimized.

The translucent coating is preferably plastisol and also preferably treated with the optical brightener. However, urethane or acrylic may be used as well. The optical brightener is preferably a fluorescent whitening agent. Preferably, the scrim is formed of woven polyester yarns. Moreover, the scrim preferably comprises a matrix defining a plurality of interstices.

The present invention is further directed to a method for producing an awning fabric. The method includes applying an optical brightener to a scrim and applying a translucent coating onto at least one side of the scrim.

The method may further include applying an opaque coating onto the translucent coating and thereafter selectively applying a solvent to the opaque coating. In this way, a selected pattern is formed on the awning fabric.

Preferably, the step of applying an optical brightener includes applying a fluorescent whitening agent including a stilbene derivative.

Preferably, the step of applying a translucent coating includes applying a plastisol coating.

An object of the present invention is to provide an awning fabric for backlit signs, the awning fabric having a scrim and wherein the visibility of the scrim is minimized.

An object of the present invention is to provide an awning fabric as described above having increased strength and durability.

An object of the present invention is to provide an awning fabric as described above which may be cost effectively manufactured.

The preceding and further objects of the present invention will be appreciated by those of ordinary skill in the art from a reading of the figures and the detailed description of the preferred embodiment which follow, such description being merely illustrative of the present invention.

DETAILED DESCRIPTION OF THE INVENTION

Figure 1:
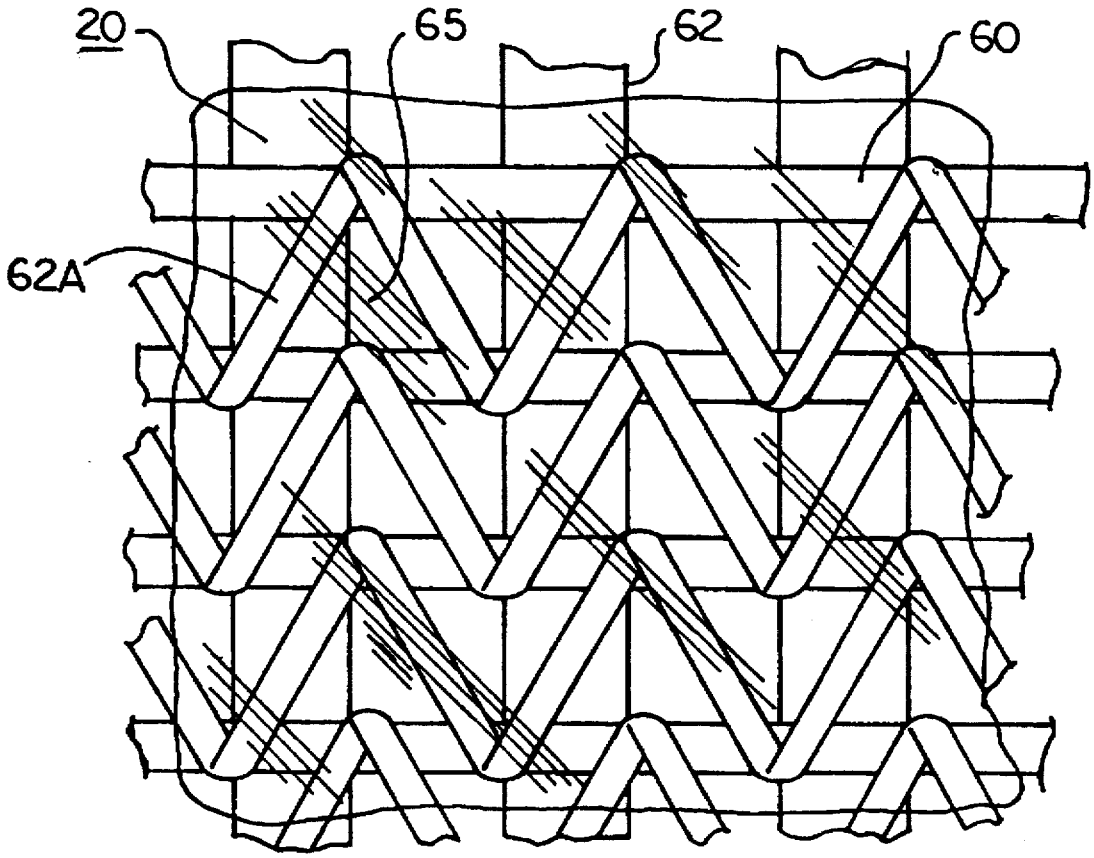
FIG. 1 is a top plan view of the awning fabric of the present invention.
Figure 2:
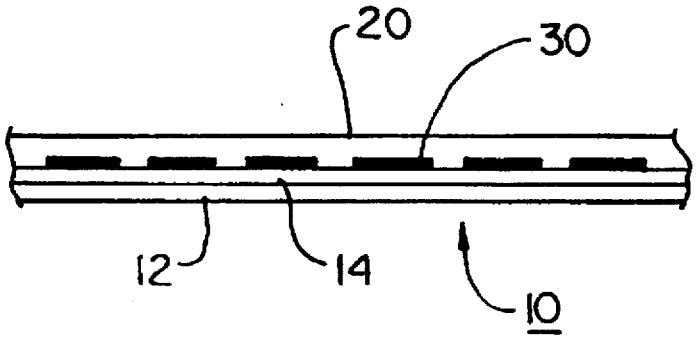
FIG. 2 is a side cross-sectional view of the awning fabric of the present invention.

With reference to the figures and to FIGS. 1 and 2 in particular, an awning fabric 10 according to the present invention is shown therein. Fabric 10 includes release paper 12, lower plastisol layer 14, scrim 30, and upper plastisol layer 20. With reference to FIG. 1, warp yarn 60 and weft yarn 62, each forming a part of scrim 30, define a matrix of interstices 65.

Release paper 12 is preferably a specially treated paper substrate having a silicon-containing coating thereon. The texture of release paper 12 is chosen to provide the desired surface aesthetic for the finished product (for example, dull or glossy). Suitable release papers include Transcoat EHR available from S. D. Warren Company. Lower plastisol layer 14 is preferably a vinyl plastisol. Suitable vinyl plastisols are available from Rutland Plastic Technologies. The vinyl plastisol is a composition preferably including PVC resin, plasticizers, and additives such as thermal stabilizers, flame retardants, biocides, pigments, and inorganic fillers. Additionally, the plastisol preferably includes optical brighteners similar to or the same as those discussed below with regard to the pretreatment of scrim 30. Such optical brighteners preferably make up from about 0.5 to about 10% by weight of the vinyl plastisol composition. Urethane or acrylic may be used in place of plastisol.

Scrim 30 is preferably formed from woven polyester yarns. However, nylon yarns may be used as well. Further, the scrim may be a knit or nonwoven fabric (e.g., polyester or polypropylene). Depending on the application, warp yarn 60 will preferably have a denier in the range of from about 220 to about 1000, most preferably 840. Weft yarn 62 will preferably have a denier in the range of from about 840 to about 1000, most preferably 1000. Weft inserted or tie yarns 62A are preferably about 70 denier nylon. Interstices 65 formed by yarns 60, 62 are preferably in the range of from about 9 by 9 yarns/inch to about 36 by 36 yarns/inch. More preferably, there are 18 warp yarns/inch and 12 fill yarns/inch. Scrim 30 is pretreated with an optical brightener. The optical brightener utilized is preferably a fluorescent whitening agent. Suitable optical brighteners include LEUCOPHOR EHB™ and LEUCOPHOR EHR™ , each available from Sandoz Chemicals Corporation of Charlotte, N.C. Scrim 30 may be treated with the optical brightener by saturation in an aqueous solution including from about 0.5% to about 20.0% by weight of the optical brightener and a small amount of acrylic or vinyl emulsion as a bonding agent for the optical brightener. Saturation may be accomplished by, for example, dip coating or transfer roll coating.

As discussed below, scrim 30 is pre-saturated with a vinyl plastisol the same as or similar to the vinyl plastisol forming lower plastisol layer 14.

Upper plastisol layer 20 is preferably formed from the same vinyl plastisol as used for lower plastisol layer 14. The plastisol preferably includes the same optical brighteners as present in the plastisol of lower plastisol layer 14.

The construction of awning fabric 10 as discussed above provides several distinct advantages over prior art awning fabrics.

The pretreatment of scrim 30 with an optical brightener as discussed above provides a scrim having greater luminescence. As a result, when the awning fabric is viewed from opposite a backlight source, less contrast is detected between the location of the scrim yarns 60, 62 and interstices 65.

Because scrim 30 is presaturated with vinyl plastisol, a continuous medium of plastisol from release paper 12 through upper plastisol layer 20, including between the fibers of scrim yarns 60, 62 and between the yarns themselves, is provided. As a result, the number and size of voids in the structure is reduced and a more homogeneous medium or path for light transmission, and hence more uniform light transmission, is provided.

The foregoing benefits result in a remarkable reduction in visible contrast between scrim 30 and interstices 65. For example, a sample of fabric according the invention was compared to a sample of PANAFLEX 930™, a product of 3M, using a MacBeth Densitometer, model no. TD931 and an aperture size setting of 2.0 mm. The scrims of the samples were formed from substantially the same denier yarns and the samples had substantially the same thickness and weight. Optical density (scale of 0 to 4.0) was measured for each sample at a yarn and at an interstice, the aperture being small enough to restrict the measurement to those locations exclusively. The following results were obtained:

| | Interstice | Yarn | Differential |
|---|---|---|---|
| Invention | 0.76 | 0.84 | 0.08 (10.5%) |
| PANAFLEX 930 ™ | 0.69 | 0.88 | 0.19 (27%) |

Thus, the difference in optical densities between the interstices and the yarns of the fabric of the present invention was only about 42% of that for a corresponding competitive product.

Significant increases in strength and durability have also been realized. For example, a fabric sample according to the present invention was compared with a sample of PANAFLEX 930™ for tongue tear and tensile strength. Test type FS191A-5134 was used to determine tear strength. Test type FS191A-5102 was used to determine tensile strength. The following results were obtained:

| | INVENTION FABRIC | PANAFLEX 930 ™ |
|---|---|---|
| weight (oz./sq. yd.) | 20 | 20 ± 1.0 |
| gauge (in.) | .022 | .021 ± .001 |
| tensile (lbs.) | 540 × 400 | 475 × 390 |
| tear (lbs./in.) | 120 × 120 | 113 × 85 |

Note:
Values for PANAFLEX 930 ™ obtained from product literature.

Note: Values for PANAFLEX 930™ obtained from product literature.

Awning fabrics according to the present invention experience substantially less color change due to UV radiation. A sample according the present invention was compared to a sample of PANAFLEX 930™ using a MacBeth Ultrascan XE colorimeter. The following results were obtained for the sample viewed in cool white fluorescent (CWF) light (which most resembles the light typically used for backlit awnings) after the indicated periods of exposure. Each value represents the degree of change since the initial exposure (i.e., from 0 hrs.). The QUV cycle consisted of 8 hours UV exposure (UVB-313 bulbs) at 50° C. and 4 hours condensation at 20° C.

| | INVENTION FABRIC | PANAFLEX 930 ™ |
|---|---|---|
| 500 hrs. QUV | 11.98 | 9.81 |
| 1000 hrs. QUV | 13.59 | 13.36 |
| 1500 hrs. QUV | 12.89 | 15.99 |
| 2000 hrs. QUV | 13.12 | 18.78 |

The difference between the ultimate measurements of the samples (13.12 versus 18.78) is significant, the invention sample being somewhat yellowed, the PANAFLEX 930™ sample being noticeably orange.

Moreover, it has been found that awning fabrics 10 according to the present invention provide a softer hand and, accordingly, a more supple drape. The resulting supple drape is highly desirable for fabrics used for awnings and similar signage applications. A sample according to the present invention was compared to a sample of PANAFLEX 930™. A King Fabric Stiffness tester model no. DFG550P was used to determine the stiffnesses of the samples with the following results.

| | STIFFNESS (LBS) WARP/FILL |
|---|---|
| Invention | 0.08/1.40 |
| PANAFLEX 930 ™ | 0.8/1.42 |

With reference to FIGS. 3–7, awning fabric 10 according to the present invention may be manufactured as follows. Fabric 10 may be produced by two passes through a single machine, two stages on a single machine, or a single pass through two separate machines. For production using a single machine for two passes, after the first pass is executed, finishing assembly 250 and scrim tension roller 252, as discussed below, may be added to the machine to execute the second pass. For the purposes of the discussion below, the process will be described as it may be practiced on two separate assembly machines 100, 200.

Figure 3:
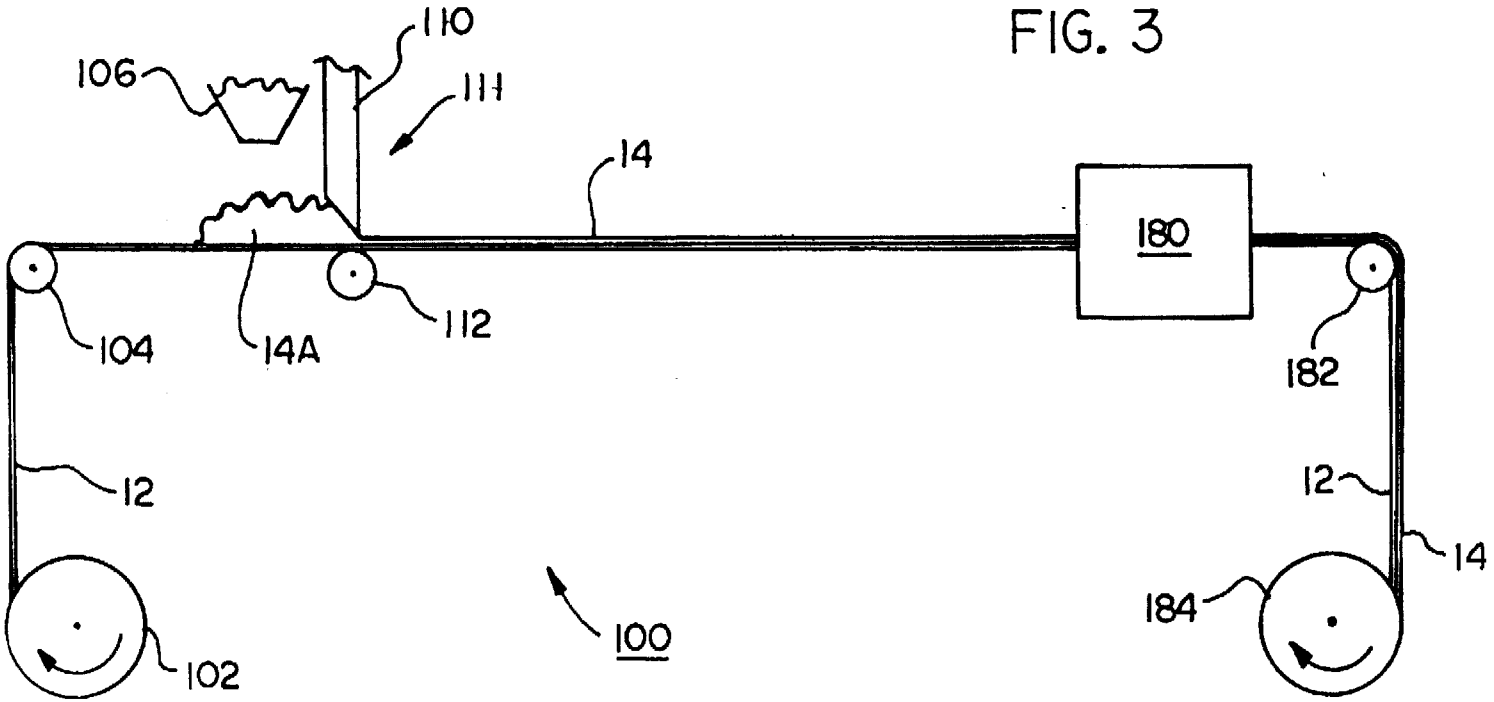
FIG. 3 is a schematic view of an apparatus for executing a first pass for forming awning fabric according to the present invention.
Figure 4:
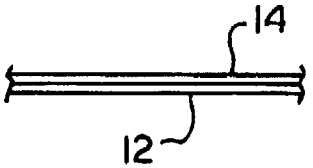
FIG. 4 is a cross-sectional view of the product of the first pass according to a method for manufacturing fabric according to the present invention.
Figure 5:
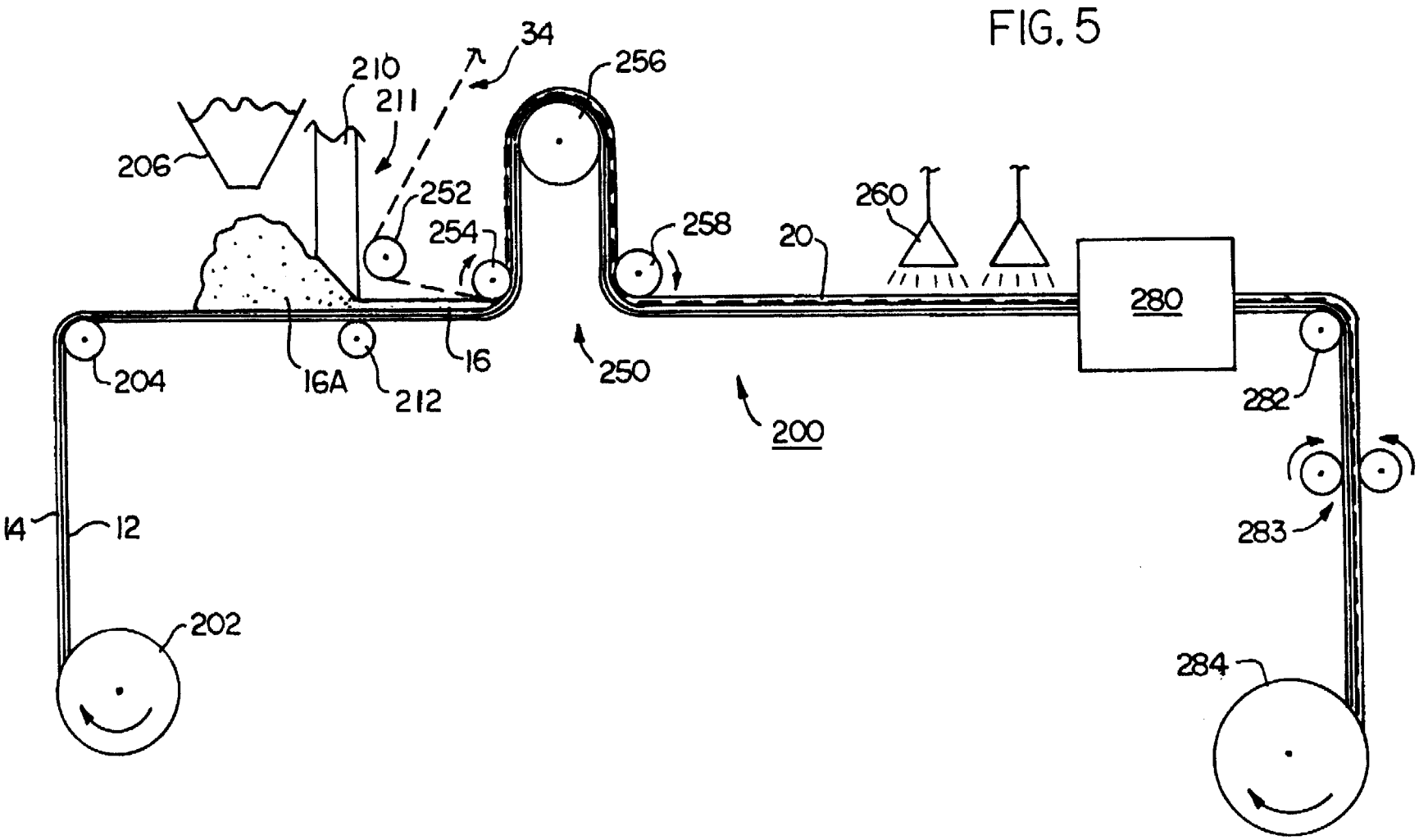
FIG. 5 is an apparatus for executing a second pass for forming awning fabric according to a method of the present invention.

The first pass is made using assembly machine 100 as best seen in FIG. 3. In the first pass, lower plastisol layer 14 is applied to release paper 12 and cured, resulting in the construction shown in FIG. 4. The second pass is made using assembly machine 200 as best seen in FIG. 5. In the second pass, transitional upper plastisol coating 16 is applied to lower plastisol layer 14. Plastisol infused scrim 34 is applied to transitional upper plastisol coating 16. Scrim 30 is then forced into transitional upper plastisol coating 16 and upper plastisol layer 20 (transitional upper plastisol coating 16 and the plastisol 32 predisposed on scrim 30) is cured. The resulting awning fabric 10 may then be treated as any other vinyl plastisol coated awning fabric.

With reference to the first pass in more detail, assembly machine 100 as best seen in FIG. 3, includes supply roller 102 from which release paper 12 is drawn. Tension roller 104 maintains release paper 12 and the subsequent coating in proper tension and alignment for the coating step. Plastisol 14A is periodically or continuously emitted from nozzle 106 as needed. Plastisol 14A may be provided to nozzle 106 from a drum or pump and is preferably filtered and stirred prior to emission from nozzle 106. Plastisol 14A is continuously drawn through knife over roller coater (hereinafter "knife/roller coater") 111. Knife/roller coater 111 includes knife 110 and roller 112. Roller 112 is positioned in contact with and supports the lower surface of release paper 12. Knife 110 is positioned relative to the upper surface of release paper 12 so as to provide the desired coating thickness as discussed below.

As plastisol 14A and release paper 12 pass through knife/roller coater 111, lower plastisol layer 14 is formed on release paper 12. Thereafter, the resulting construction is conveyed through oven 180. Oven 180 may be, for example, a gas oven, an electric oven, or an infrared oven. Preferably, each portion of the construction is exposed to temperatures between 350°–400° Fahrenheit for a period of from about 1 minute to about 5 minutes.

Preferably, the resulting lower plastisol layer 14 will be in the range of about 0.5 mil to about 10 mils, 9 mils being most preferred. Notably, the cured film thickness will be approximately 66% of the gap between knife 110 and the upper surface of release paper 12.

Finally, the construction is wound onto take-up roller 184, the tension and alignment of the construction being maintained by tension roller 182.

The second pass is performed on assembly machine 200 as best seen in FIG. 5. Assembly machine 200 includes supply roller 202 from which release paper 12 with upper plastisol layer 14 thereon is drawn. Release paper 12 with upper plastisol layer 14 thereon is conveyed beneath nozzle 206 while the tension is maintained by tension roller 204. Plastisol 16A is deposited on the upper surface of upper plastisol layer 14 from nozzle 206. Transitional upper plastisol coating 16 is formed on the upper surface of upper plastisol layer 14 by knife/roller coater 211 which includes knife 210 and roller 212. Next, plastisol infused scrim 34 is laid onto transitional upper plastisol coating 16 by means of finishing assembly 250 and scrim tension roller 252.

Figure 7:
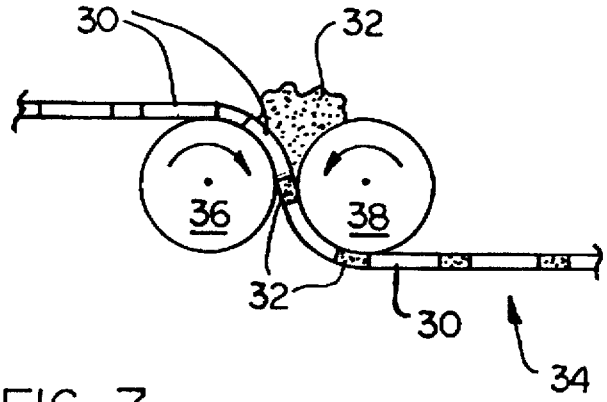
FIG. 7 is a schematic view of an apparatus for pretreating a scrim for forming an awning fabric according to the present invention.

Prior to being supplied to assembly machine 200, plastisol induced scrim 34 is produced as follows and with reference to FIG. 7. First, scrim 30 is pretreated with an optical brightener as discussed above. The optical brightener pretreatment may be accomplished by saturation with an aqueous solution as described above. Saturation may be accomplished by, for example, dip coating or transfer roll coating. Next, optically brightened scrim 30 is drawn through first meter roller 36 and second meter roller 38 as plastisol 32 is forced into the scrim under pressure. Depending on the construction of scrim 30 and the composition of plastisol 32, the pressure used to infuse plastisol 32 into scrim 30 will preferably be on the order of from about 0.5 psi to about 40 psi. The resulting plastisol infused scrim 34 comprises scrim 30 having plastisol 32 infused within interstices 35 and between a substantial portion of the fibers comprising yarns 60, 62. In this way, scrim 30 is saturated with plastisol 32 and is effectively de-aired.

Figure 6:
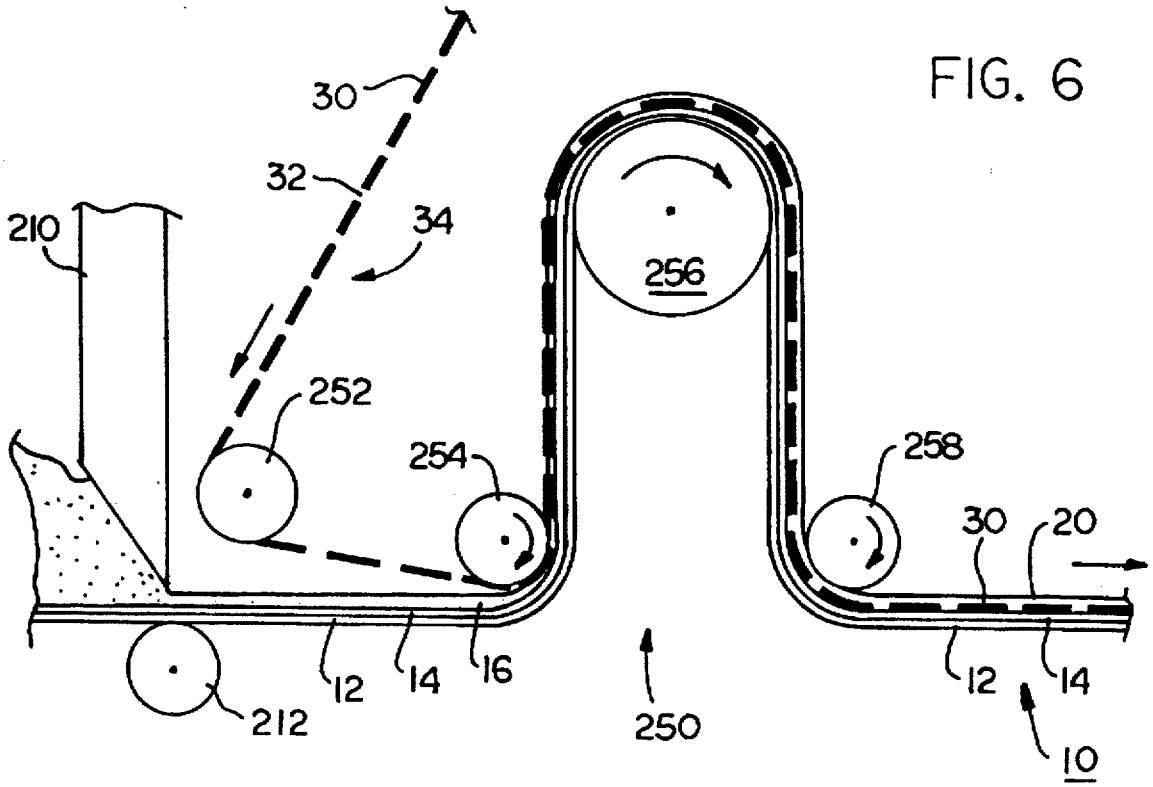
FIG. 6 is a schematic view of the finishing assembly forming a part of the apparatus for forming awning fabric according to the present invention.

With reference to FIG. 6, it will be seen that the angle of entry of infused scrim 34 into transitional upper plastisol layer 16 is determined by the placement of first finishing roller 254 and scrim tension roller 252. Preferably, the angle of entry (the angle defined between the plastisol infused scrim 34 stretched from roller 252 to 254 and the upper surface of transitional upper plastisol layer 16) is in the range from about 5° to about 35°. The combination of the presaturation of scrim 30 with plastisol 32 and the selective angle of entry serves to drastically reduce the capturing of air bubbles in the construction.

The resulting construction is then conveyed through finishing assembly 250. First finishing roller 256 rotates opposite the direction of the path of the construction. Second finishing roller 256 rotates in the direction of the web. Finishing assembly 250 serves to uniformly distribute and smooth the upper plastisol layer. In this way, finishing assembly 250 compensates for speed fluctuations in the conveyance of the web and irregularities caused by the nipping of the scrim into the plastisol layer.

Additionally, plastisol infused scrim 34 is drawn tightly across second finishing roller 256 so that it is pulled down through transitional plastisol layer 16 and proximate or onto lower plastisol layer 14. As a result, scrim 30 is insulated by a portion of the upper layer of plastisol. Additionally, plastisol 32 infused within scrim 30 is intermingled with transitional upper plastisol layer 16, thereby forming continuous and homogeneous upper plastisol layer 20.

It will be appreciated that because scrim 30 is substantially de-aired and is introduced to transitional plastisol 16 so as to avoid the introduction of air into the construction, it is not necessary to practice a de-airing operation on the resulting construction prior to curing. This is of substantial benefit to the process because of the nature of the vinyl plastisol used. In conventional methods, it is necessary to heat the fabric to percolate air bubbles which have been trapped during the process. This requires relatively controlled conditions because of the behavior of the plastisol's viscosity as a function of temperature. Typically, the viscosity of the plastisol will drop as temperature rises up to a point, and thereafter the viscosity will rise to a gel point and then to a fusion point.

Though not necessary to de-air the construction, preheat or infrared lamps 260 may be used to preheat the construction prior to introduction to oven 280. Upper plastisol layer 20 is cured in oven 280. The tension of awning fabric 10 is maintained by tension roller 282. Awning fabric 10 may optionally be processed through calender 283 and finally collected on take-up roller 284.

While a preferred embodiment of the present invention has been described, it will be appreciated by those of skill in the art that certain modifications may be made without departing from the scope of the present invention. For example, the scrim may be pretreated with biocides, anti-wicking agents, and various sizing solutions. The plastisol may include pigment to provide a translucent, colored fabric. The finished construction could have a top coat to provide chemical and weather resistance. All such modifications are intended to come within the scope of the claims which follow.

What is claimed is:

1. An awning fabric for use with a light source disposed on one side of said awning fabric, comprising:

a) a scrim, said scrim treated with an optical brightener;

b) a translucent coating on at least one side of said scrim, said coating including a plastisol; and c) whereby, when said awning fabric is viewed by an observer from the side opposite the light source, the visibility of said scrim to the observer is minimized.

2. The awning fabric of claim 1 wherein said plastisol comprises a plastisol optical brightener.

3. The awning fabric of claim 2 wherein said plastisol optical brightener makes up from about 0.5% to about 10% by weight of said plastisol.

4. The awning fabric of claim 2 wherein said plastisol optical brightener comprises a stilbene derivative.

5. The awning fabric of claim 1 wherein said optical brightener comprises a stilbene derivative.

6. An awning fabric for use with a light source disposed on one side of said awning fabric, comprising:

a) a scrim, said scrim treated with an optical brightener and formed of woven polyester yarns;

b) a translucent coating on at least one side of said scrim; and c) whereby, when said awning fabric is viewed by an observer from the side opposite the light source, the visibility of said scrim to the observer is minimized.

7. The awning fabric of claim 1 wherein said scrim comprises a plurality of yarns and a plurality of interstices defined by said yarns, and wherein the optical density of each of said yarns is no more than about 26% greater than the optical density of each of said interstices.

8. The awning fabric of claim 7 wherein said optical density of each of said yarns is not more than about 10.5% greater than said optical density of each of said interstices.

9. The awning fabric of claim 7 wherein said fabric has a tensile strength of at least about 540 lbs. by 400 lbs.

10. The awning fabric of claim 7 wherein said fabric has a tear strength of at least about 120 lbs. per inch by 120 lbs. per inch.

11. An awning fabric for use with a light source disposed on one side of said awning fabric, comprising:

a) a scrim formed of woven polyester yarns treated with an optical brightener;

b) a translucent coating disposed on at least one side of said scrim, said translucent coating including a plastisol; and c) whereby, when said awning fabric is viewed by an observer from the side opposite the light source, the visibility of said scrim to the observer is minimized.

12. The awning fabric of claim 11 wherein said plastisol comprises an optical brightener.

13. The awning fabric of claim 12 wherein said optical brightener makes up from about 0.5% to about 10% by weight of said plastisol.

14. The awning fabric of claim 11 wherein said woven polyester yarns define a plurality of interstices, and wherein the optical density of each of said yarns is no more than about 26% greater than the optical density of each of said interstices.

15. The awning fabric of claim 11 wherein said optical density of each of said yarns is not more than about 10.5% greater than said optical density of each of said interstices.

16. The awning fabric of claim 14 wherein said fabric has a tensile strength of at least about 540 lbs. by 400 lbs.

17. The awning fabric of claim 14 wherein said fabric has a tear strength of at least about 120 lbs. per inch by 120 lbs. per inch.

18. The awning fabric of claim 6 wherein said coating includes a plastisol.

19. The awning fabric of claim 18 wherein said plastisol comprises a plastisol optical brightener.

20. The awning fabric of claim 19 wherein said plastisol optical brightener makes up from about 0.5% to about 10% by weight of said plastisol.

21. The awning fabric of claim 19 wherein said plastisol optical brightener comprises a stilbene derivative.

22. The awning fabric of claim 6 wherein said optical brightener comprises a stilbene derivative.

23. The awning fabric of claim 6 wherein said scrim comprises a plurality of yarns and a plurality of interstices defined by said yarns, and wherein the optical density of each of said yarns is no more than about 26%, greater than the optical density of each of said interstices.

24. The awning fabric of claim 23 wherein said optical density of each of said yarns is not more than about 10.5% greater than said optical density of each of said interstices.

25. The awning fabric of claim 23 wherein said fabric has a tensile strength of at least about 540 lbs. by 400 lbs.

26. The awning fabric of claim 23 wherein said fabric has a tear strength of at least about 120 lbs. per inch by 120 lbs. per inch.

27. A method for producing an awning fabric, comprising the steps of:

a) applying an optical brightener to a scrim;

b) applying a translucent coating onto at least one side of the scrim; and c) applying a relatively opaque coating onto the translucent coating and thereafter selectively applying a solvent to the opaque coating thereby forming a selected pattern on the awning fabric.

28. The method of claim 27 wherein said step of applying an optical brightener includes applying a fluorescent whitening agent comprising a stilbene derivative.

29. A method for producing an awning fabric, comprising the steps of:

a) applying an optical brightener to a scrim; and b) applying a translucent plastisol coating onto at least one side of the scrim.

* * * * *